United States Patent [19]

Sigmund

[11] 4,163,310

[45] Aug. 7, 1979

[54] TIGHTENING SYSTEM

[75] Inventor: Jerry A. Sigmund, Willow Grove, Pa.

[73] Assignee: SPS Technologies, Inc., Jenkintown, Pa.

[21] Appl. No.: 755,409

[22] Filed: Dec. 29, 1976

[51] Int. Cl.[2] ..... B25B 23/14

[52] U.S. Cl. ..... 29/407; 73/761; 173/12

[58] Field of Search ..... 73/88 F, 139, 761; 173/1, 12; 81/52.4 R, 52.4 B, 52.5; 29/240, 407

[56] References Cited

U.S. PATENT DOCUMENTS

| | | | |
|---|---|---|---|
| 3,962,910 | 6/1976 | Spyridakis et al. | 73/88 F |
| 3,973,434 | 8/1976 | Smith | 73/139 |
| 3,974,685 | 8/1976 | Walker | 73/88 F |
| 3,982,419 | 9/1976 | Boys | 73/139 |

*Primary Examiner*—Charles A. Ruehl
*Attorney, Agent, or Firm*—Aaron Nerenberg

[57] ABSTRACT

A tightening and control system is disclosed for automatically tightening a fastener to a predetermined tightened condition in a workpiece, where the fastener is of the type which exhibits more than one installation region on a graph of two tightening characteristics during a complete tightening cycle. Typical of such fasteners are thread tapping fasteners, such as thread-cutting or thread forming types, which first generate a mating thread in a workpiece material and thereafter are tightened in the workpiece to a predetermined load condition. Such fasteners typically exhibit a curve of two related input tightening characteristics, such as torque and rotation, having a thread forming region characterized by a generally linear portion followed by a marked drop off in the slope, an intermediate region having several possible characteristic shapes, and a tightening region having a somewhat similar shape to the thread forming region. Apparatus is generally disclosed for determining the gradient of the torque-rotation curve through which the assembly is being tightened, determining when a first condition indicative of having formed the thread has occurred, and thereafter determining when the tightening region has been reached. The gradient information is utilized to determine when tightening should be discontinued at the predetermined tightened condition. Typically, this predetermined tightened condition may be the yield point of the assembly. Alternatively, the instantaneous torque value at the first condition is obtained and stored, and tightening is discontinued when the instantaneous torque bears some predetermined relationship to the instantaneous torque value at the first condition.

38 Claims, 6 Drawing Figures

TIGHTENING SYSTEM

BACKGROUND OF THE INVENTION

This invention relates generally to tightening and tightening control systems, and more particularly to systems for tightening fasteners which exhibit more than one installation region during a complete tightening cycle. Thread forming fasteners are one example of such fasteners.

In order to properly install a thread forming fastener into an unthreaded workpiece hole, a first torque value must be reached in order to form the thread and a final tightening torque must be applied in order to properly seat and tighten the fastener. These torques may be referred to, respectively, as the thread forming torque and the seating torque. In order to install a thread forming fastener, a hole of the proper size for a particular sized fastener is drilled, pierced, or extruded in the workpiece material, and the fastener is then rotated into the hole. Tolerance on the hole size is of critical importance. If the hole is too small, the torque required to drive the fastener may become so large that the fastener will fail in torsion. If the hole is too large, the integrity of the fastened joint is compromised. Workpiece material characteristics (i.e. hardness, toughness, etc.) and thickness also have an effect on the performance of a thread forming fastener. As the hardened thread of the fastener enters the hole, the fastener thread displaces the workpiece material to form a mating thread. The softer the material, the easier it is to form the threads. Conversely, if the material is hard, dense and tough, less material can be extruded and greater energy is necessary to form the thread. Thus, the required initial hole diameter for a particular size thread forming fastener depends upon a number of physical variables, all of which contribute in varying degrees to the energy or torque needed to form the thread.

Present assembly tools for installing thread forming fasteners are generally of the torque control variety. Normally, a single torque setting is selected and set into the tool, the torque value corresponding to the final desired seating value. This torque setting must be sufficiently high in order to form a mating thread under the most severe conditions of hole size, thickness, and material properties which are expected to be encountered. However, this torque must not be set so high as to cause stripping of the threads when the same variables interact to minimize the thread forming torque necessary in a particular joint. Stripping may be conveniently defined as a mode of thread failure wherein the internal thread material is sheared away from the remainder of the workpiece. Thus, the thread forming torque to stripping torque ratio becomes critical when assembling a number of joints, even in the same workpiece material. It is furthermore desirable to install a particular size fastener into a variety of holes of varying initial diameters in different materials having diverse physical characteristics with a single installation tool.

Referring to FIG. 1, the two torque vs. rotation curves shown represent extremes of physical conditions which could be encountered in two separate joints in the same or different workpieces. No single torque setting satisfies both conditions. For example, if the torque is set at a value corresponding to $[(T_S)_B]$ in the installation tool, fastener B may be tightened to the correct seating torque value, but this value will not be sufficient to form the thread in fastener A. Conversely, if a torque value $[(T_S)_A]$ is set in the tool, the threads in fastener B will be stripped. It is this type of problem which has severely limited the use of automatic tightening equipment for tightening thread forming fasteners, and further has limited the use of threads forming fasteners themselves in many structural applications where their use would be beneficial. These and other problems are overcome by the present invention.

SUMMARY OF THE INVENTION

Accordingly, it is a general purpose and object of the present invention to provide a tightening and control system for reliably tightening an assembly to a predetermined tightened condition where the assembly includes a fastener which exhibits more than one installation region on a graph of two tightening characteristics during a complete tightening cycle. It is another object to provide a tightening and control system for reliably installing thread tapping fasteners such as, for example, thread forming fasteners into a variety of workpiece materials with minimum knowledge of the physical characteristics of the joint being tightened. It is still another object to provide a tightening and control system for generating threads in a mating workpiece material and thereafter reliably seating the fastener to a predetermined tightened condition in the workpiece.

These and other objects are accomplished according to the present invention by apparatus and a method for installing a fastener which is capable of generating a mating internal thread in a workpiece hole to a final desired tightened condition. The apparatus includes means for detecting a thread-forming characteristic of the fastener, and means responsive to the thread-forming characteristic and at least one known characteristic of the fastener for determining the final desired tightened condition.

DESCRIPTION OF THE PREFERRED EMBODIMENTS

Figure 1:
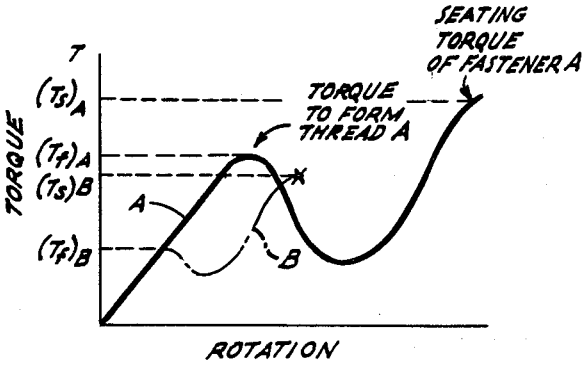
FIG. 1 is a graph of torque plotted against rotation illustrating extreme conditions of thread forming fastener installations.

As previously discussed, FIG. 1 is a graph of torque vs. rotation showing tightening curves for two fasteners which exhibit more than one installation region. An installation region is generically defined as having a portion with a positive slope followed by a marked drop off in the slope. Throughout the following discussion it should be remembered that the present invention pertains to any fastener which exhibits multiple installation regions during a complete tightening cycle. For purposes of illustration only, thread tapping screws, and more particularly, thread forming or thread swaging screws will be referred to. In FIG. 1 it can be seen that the torque to form thread A [$(T_f)_A$] and the torque to seat fastener A [$(T_s)_A$] are both higher than the corresponding values [$(T_f)_B$] and [$(T_s)_B$] for fastener B. Since this variation in forming and seating torques can occur from hole to hole in the same workpiece or in different workpieces, and since there is no reliable way of determining in advance what the respective values will be in a particular hole, there is no single torque setting which can be preset on a conventional automatic tightening tool in order to reliably install a number of fasteners in holes having varying physical characteristics.

Figure 2:
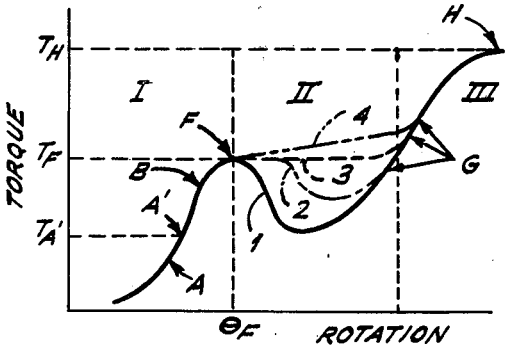
FIG. 2 is a graph of a typical torque versus rotation curve showing a number of different possible characteristic shapes which could be generated by fasteners exhibiting more than one installation region.

In order to overcome this problem, the present invention contemplates separate control over the thread forming process and the final tightening process. Referring now to FIG. 2, region I represents the thread forming region which is characterized by an initial portion below point A followed by a generally linear portion between points A and B, and a subsequent non-linear portion beyond point B. Point F on the torque-rotation curve adjacent the end of thread forming region I represents the torque necessary to form a mating thread in a workpiece hole. Point F then represents the achievement of a first condition just beyond the thread forming region, and the torque value at point F will be referred to as the thread forming torque ($T_F$). Region II is an intermediate or transition region in which the torque may vary in several ways with respect to the rotation of the fastener. In curve 1, the torque begins to decrease almost immediately after reaching ($T_F$) and the torque-rotation curve assumes a negative slope or gradient in region II. After some additional amount of rotation, the torque stops decreasing and begins to increase, with the slope of the curve changing from negative to positive. When the slope becomes generally constant, at approximately point G, final tightening of the fastener in the joint has begun. In curve 2, the torque remains relatively constant after reaching ($T_F$) and, after some additional amount of rotation, begins to decrease and then increase as in the case of curve 1. In curve 3 the torque value remains constant after reaching ($T_F$) and then begins to increase, indicating the start of the final tightening region of the curve. In curve 4, the torque value continues to increase after reaching ($T_F$), either in a generally linear manner as shown, or in a non-linear manner until there is a marked increase in the positive slope, indicating the beginning of the final tightening region of the curve. Region III identifies the final tightening region of the curve in which additional torque is applied to the fastener in order to produce a final tightened condition at ($T_H$), for example. Stated in another way, a predetermined amount of tension load may be induced in the fastener at the predetermined tightened condition. This region of the curve includes a generally linear portion, as in the case of the generally linear portion of the thread forming region. There is not necessarily any relationship between the relatively constant slope of the generally linear portion in region I and in region III. The slope in region III is determined in part by such factors as foreign manner between the mating threads, lubrication between the mating threads, and coatings on the fastener, among other factors. For a complete discussion of this point, as well as other points which will be referred to hereinafter, reference is made to U.S. Pat. No. 3,982,419 for "Apparatus For And Method of Determining Rotational And Linear Stiffness" by John T. Boys, the disclosure of which patent is incorporated herein by reference. The fastener is tightened to the predetermined tightened condition illustrated by point H on the curve, at which point further tightening is discontinued.

Figure 3:
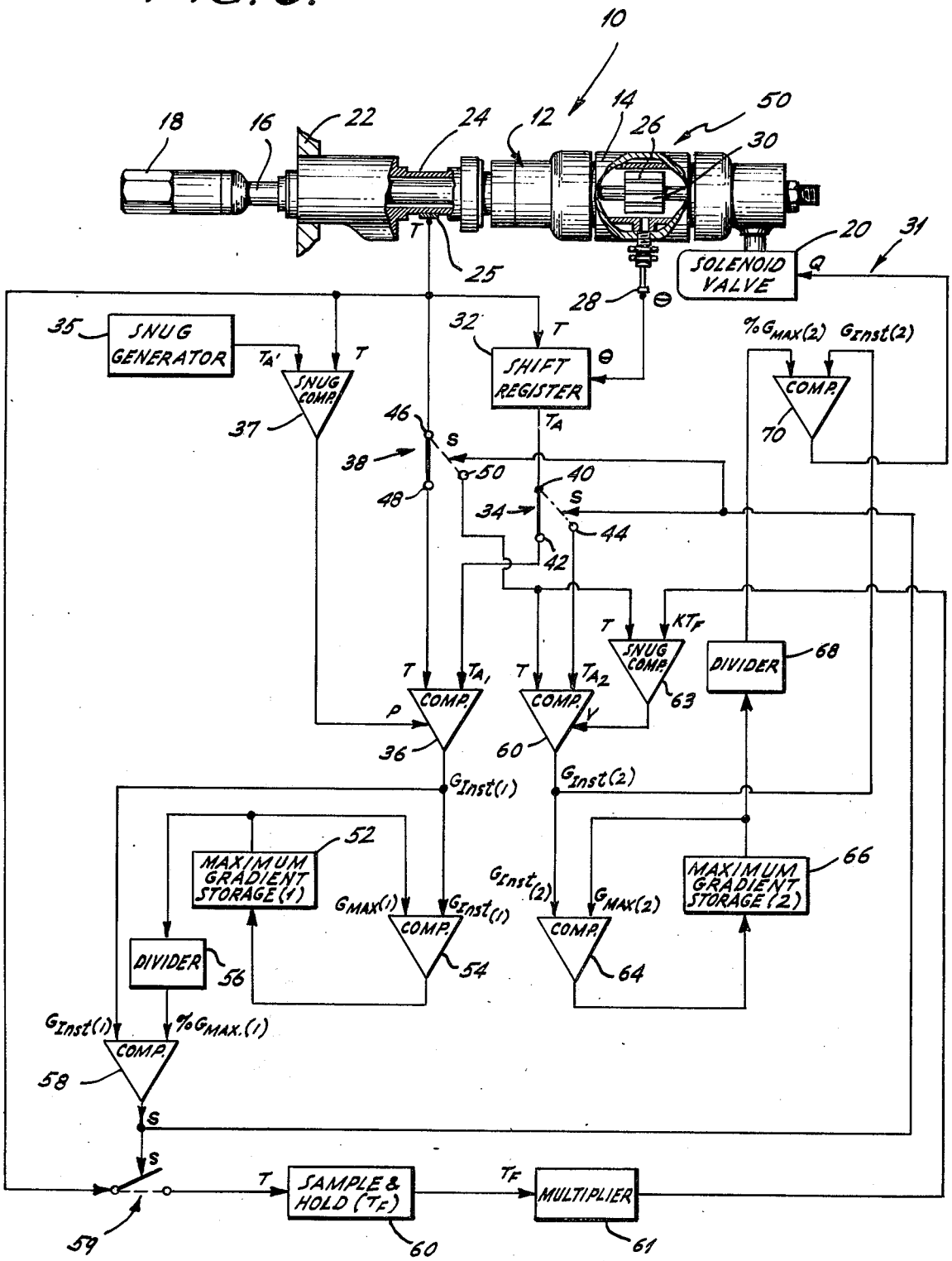
FIG. 3 is a schematic block diagram of a first embodiment of the invention.

One embodiment of the tightening and control system in accordance with the present invention is illustrated in FIG. 3. Tightening system 10 includes a wrench 12 having a motor 14, an output drive shaft 16 and a driver bit 18. Drive shaft 16 is driven by motor 14 to apply torque and impart rotation to a fastener member engaged by driver bit 18. Wrench 12 can be of any conventional type and as is most common, motor 14 can be air powered with the flow of motive fluid being controlled by a suitable electrically operated solenoid control valve 20. It should be understood that motor 14 could also be electric, hydraulic or any combination of pneumatic, hydraulic or electric. The exact details of the wrench are not necessary for a proper understanding of the invention and, accordingly, a more specific description is not provided.

Mounted between the housing of motor 14 and a rigid frame 22 on which the wrench is carried, is a suitable transducer or torque cell 24 for generating a varying signal representative of the instantaneous torque being applied to the fastener. Torque cell 24 can be any of a variety of well known conventional devices, and in the embodiment disclosed herein comprises a somewhat flexible annular member having strain gauges 25 secured to its outer periphery so that the reaction torque on the wrench is measured and an electrical signal is generated. The reaction torque is, of course, equal to and opposite the torque being applied to the fastener. Mounted on drive shaft 16 for rotation therewith and preferably within motor 14, is a suitable encoder 26 that cooperates with a proximity detector 28 for developing signals representative of the incremental angular displacement or rotation of the fastener. Encoder 26 can be any of a variety of suitable devices and in this embodiment includes a series of teeth 30 formed on its outer periphery. Proximity detector 28 senses the presence of metal and, thus, the passage of the teeth and develops an electrical signal representative of predetermined increments of angular rotation. While examples of torque and rotation measuring devices have been described, it should be understood that any of a variety of readily available devices for accomplishing the noted result can be utilized in accordance with the invention.

A control circuit 31 is operatively associated with wrench 12 for controlling the tightening of the fastener and includes a gradient calculating system that determines the instantaneous gradient or slope of the torque-rotation curve, which could be plotted on a graph if desired, for the particular fastener being tightened, and develops an electrical signal representative thereof. The gradient calculating system comprises a shift register 32 to which instantaneous torque signal (T) is fed and whose output is clocked by rotation signals ($\theta$) at fixed increments of angular rotation. Accordingly, the output ($T_A$) of shift register 32 is a signal representative of torque a predetermined number of degrees of rotation previous to the instantaneous rotation, and is fed through a conventional two position switch 34 into a comparator 36. Instantaneous torque signals (T) from torque cell 24 are fed through a conventional two position switch 38 to another input of comparator 36. Comparator 36, in the form of a suitable subtraction circuit, receives signal (T) and signal ($T_{A1}$) from shift register 32 and provides an output signal representative of the difference therebetween. Since torque signals are subtracted over fixed increments of rotation, the output signal from comparator 36 is representative of the instantaneous gradient of the torque-rotation curve in thread forming region I of the tightening cycle.

While torque and rotation have been selected in the present embodiment, it should be understood that any other torque-related function such as fastener elongation, stress, motor speed, washer compression, torque gradient etc., could be utilized, as well as any other function associated with the continued tightening of the fastener, such as time, strain, etc. Examples of some of these additional parameters which could be used for controlling the tightening of a fastener are described in U.S. Pat. application Ser. No. 672,093, now U.S. Pat. No. 4,027,530, for "Simplified Apparatus For And Method Of Tightening Fasteners" by Angelo L. Tambini and Paul W. Wallace, filed on Mar. 31, 1976, and U.S. Pat. application Ser. No. 672,094, now U.S. Pat. No. 4,023,406, for "Tightening System With Torque-Time Control" by John W. Benz, Jr., filed on Mar. 31, 1976, the disclosures of said patents being incorporated herein by reference.

In the first position of switch 34, contacts 40 and 42 are connected. As will be discussed more fully hereinafter, upon developing a control signal indicating that a first condition has been reached wherein the thread forming torque ($T_F$) has been generated, switch 34 will shift to the second position connecting contact 40 with a contact 44. Similarly, in the first position of switch 38, contact 46 is connected to a contact 48, while in the second position contact 46 is connected to a contact 50.

At this point it should be noted that while the torque-rotation curve in FIG. 2 is generally linear from points A to B in region I, this portion of the curve may include temporary spikes which are caused by temporary seizing of the mating threads or by temporary acceleration of rotation caused by lack of or excessive lubricant, respectively, on a particular point on the threads for any particular fastener. Thus, the output of comparator 36, which would be a signal of constant magnitude if the torque-rotation curve were exactly linear from point A to point B, may experience certain changes. Normally the gradient of the curve will be substantially constant from point A to point B (i.e. the curve will approximate to a straight line), but if this portion of the curve is not linear, the gradient will reach a typical maximum value. Accordingly, this portion may be considered as the generally linear portion of the curve. For this reason the gradient calculating system may include circuits for determining and storing the maximum gradient experienced up to any point along the torque-rotation curve, that is, up to any point in thread forming region I of the curve. In effect, the maximum gradient experienced in the generally linear portion of region I is considered to be the gradient for that region of the curve. Only the maximum gradient is stored and becomes the constant gradient of the generally linear portion of the curve, as will be more fully explained hereinafter. Accordingly, a storage circuit 52 is provided which circuit stores a signal representative of the maximum gradient so far encountered, and a comparator 54 is provided for comparing instantaneous gradient signals with the previously stored maximum gradient signal from storage circuit 52. If an instantaneous gradient signal [$G_{Inst\,(1)}$] is larger than a stored gradient signal [$G_{Max\,(1)}$], the instantaneous gradient signal is then stored in storage circuit 52. For a fuller description of storage circuit 52 and comparator circuit 54, reference is made to previously mentioned U.S. Pat. No. 3,982,419. It should be noted that in order to ensure that the control system does not shut off prematurely prior to point A in the initial or pre-tightening portion of region I, computation of the torque gradient may be delayed until point A' on the generally linear portion of the curve is reached. Expressed in another way, rotation prior to "turn-on" point A' may be disregarded until a torque value ($T_{A'}$) has been reached. Reference here is made to U.S. Pat. No. 3,974,883 for "Tightening System" by Jerry A. Sigmund, and more particularly to FIG. 3 and the explanation thereof for a fuller understanding of this point. In order to turn on the gradient computation circuitry at point A', a snug generator 35 may be employed to produce a signal indicative of a preset torque value ($T_{A'}$) which might typically be approximately 20% to 50% of the anticipated thread forming torque value ($T_F$). The signal from generator 35 is introduced along with torque signal (T) from the wrench to a comparator 37 in the form of a suitable subtraction circuit. When the instantaneous torque value (T) equals the preset torque value ($T_{A'}$), a signal (P) is issued to enable comparator 36 to begin determining the torque gradient. Signal [$G_{Max\,(1)}$] from storage circuit 52, indicative of the maximum gradient in the generally linear portion of the curve, is fed into a divider circuit 56 where the maximum stored gradient value is divided by a predetermined fixed value to reduce the signal. Typically, the maximum gradient signal is reduced to between approximately 25% to 75% of the peak or maximum value, and generally to approximately ⅔ of the maximum value. The reduced signal from divider circuit 56 [$\%G_{Max\,(1)}$] is introduced along with the instantaneous gradient signal [$G_{Inst\,(1)}$] from comparator 36 into a comparator 58 in the form of a substraction circuit. When the two input signals to comparator 58 are approximately equal, an output signal (S) is produced which is utilized to shift switches 34 and 38 to their respective second positions wherein contact 40 is connected to contact 44, and contact 46 is connected to contact 50. Output signal (S) indicates that the first condition in the thread forming region has been reached. That is, point F, representative of the thread forming torque value ($T_F$) in FIG. 2 has been reached. Thereafter, transition region II must be passed before tightening region III is reached.

Referring again to FIG. 3, when switches 34 and 38 are in their respective second positions, signals (T) from the wrench and ($T_{A2}$) from shift register 32 are introduced into a comparator 60 which is similar in function to comparator 36. In order to avoid any inaccuracies in region III of FIG. 2, a second snug level may be established as a function of the thread forming torque ($T_F$). This is accomplished by determining the thread forming torque ($T_F$) and multiplying it by a fixed constant to establish the snug torque value for tightening region III. Signal (S) from comparator 58 actuates a normally open single-throw switch 59 to a closed position, allowing output torque signal (T) from the wrench to pass to sample and hold circuit 60. Thread forming torque value ($T_F$) is stored and an output signal from circuit 60 indicative thereof is introduced into multiplier circuit 61 where it is multiplied by a fixed constant (K). Constant (K) may typically be any value between 0.5 and 1.5, depending on the characteristic shape of the torque-rotation curve in region II and the type of joint being tightened. A preferable value of 1.1 may be used in most cases where the curve is similar to curves 1 and 2 in FIG. 2. Output signal ($KT_F$) from multiplier 61 is introduced into a snug comparator 63 in the form of a suitable subtraction circuit, the other input to comparator 63 being instantaneous torque value (T). The output signal (V) from comparator 63 serves to delay computation of the instantaneous gradient [$G_{Inst\,(2)}$] in comparator 60 until the second generally linear portion of the curve, as indicated by points G for the various examples of curves, are reached. It should be understood, however, that utilization of the snug values is optional, and that the control system shown in the present embodiment could function without using snug signals (P) and (V) for turn on. The instantaneous gradient [$G_{Inst\,(2)}$] from comparator 60 is introduced into a comparator 64 along with a maximum gradient signal [$G_{Max\,(2)}$] from storage circuit 66, which is comparable to storage circuit 52. The maximum gradient signal is divided by a predetermined fixed constant in a divider circuit 68, which is similar to divider circuit 56, and the output signal from divider circuit 68 [$\%G_{Max\,(2)}$] is introduced along with the instantaneous gradient signal [$G_{Inst\,(2)}$] from comparator 60 into a comparator 70, which is similar to comparator 58. When the two signals are approximately equal, indicating that the final tightened condition, represented by point H in region III of the torque-rotation curve of FIG. 2 has been reached, comparator 70 produces a signal (Q) to solenoid valve 20 closing the valve and shutting off tightening system 10. It should be noted that the shut off point may typically be the yield point of the joint.

Figure 4:
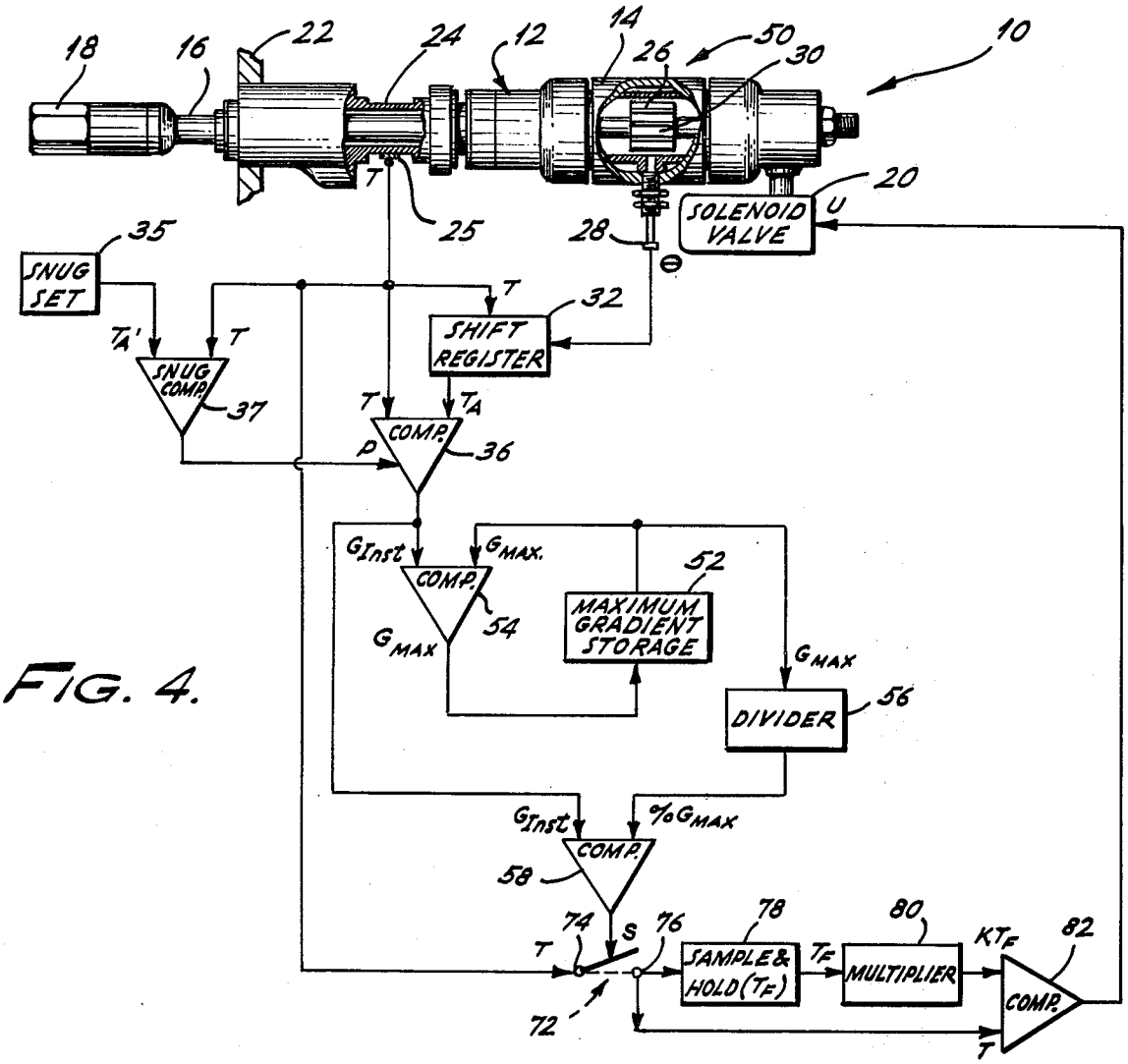
FIG. 4 is a schematic block diagram of a second embodiment of the invention.

Referring now to FIG. 4, a second embodiment of the present invention is illustrated. The system shown in FIG. 4 is similar to a portion of the system shown in FIG. 3 and accordingly like numerals will be used for like elements. The tightening and control system illustrated in FIG. 4 includes a wrench exactly as described in the previous embodiment. Torque (T) and angle measurements ($\theta$) are fed into shift register 32 which produces an output signal ($T_A$) representative of torque a predetermined number of degrees of rotation previous to the instantaneous rotation. Output signal ($T_A$) from shift register 32 is fed into comparator 36 along with instantaneous torque signal (T). Comparator 36 being in the form of a subtraction circuit produces a signal indicative of the instantaneous gradient ($G_{Inst}$) of the torque-rotation curve through which the fastener is being tightened. As in the previous embodiment, a snug generator 35 can be introduced in order to disregard any inputs in the portion of the curve below point A in FIG. 2. The output signal from snug generator 35 ($T_{A'}$) is fed along with instantaneous torque signal (T) to snug comparator 37 which issues an output signal (P) when the two values are approximately equal. Output signal (P) is used to enable comparator 36 in order to begin computation of instantaneous gradient ($G_{Inst}$). The maximum gradient ($G_{Max}$) experienced is stored in storage circuit 52 and is continuously compared with instantaneous gradient signal ($G_{Inst}$) in comparator 54. Maximum gradient signal ($G_{Max}$) is then divided in divider circuit 56, whose output signal ($\%G_{Max}$) is compared with instantaneous gradient signal ($G_{Inst}$) in comparator 58 to determine when thread forming torque ($T_F$) in FIG. 2 is reached. Output signal (S) from comparator 58 is used to close a normally open, single throw switch 72. When switch 72 is closed, contacts 74 and 76 are connected allowing instantaneous torque signal (T) to be introduced into a sample and hold circuit 78 which stores the instantaneous torque value ($T_F$) at the first condition (point F in FIG. 2). The output from sample and hold circuit 78 ($T_F$) is introduced into a multiplier circuit 80 which multiplies the torque value at the first condition by a fixed amount (K). This fixed value (K) could be determined by experimental tests on joints similar to the type being tightened. A predictable ratio between thread forming torque value ($T_F$) and the final seating torque value ($T_H$) at the final tightened condition, such as at the yield point of the joint, exists for some joints. For joints which exhibit this predictable relationship, control based upon a final torque value ($T_H$) which bears a relationship to the measured thread forming torque value ($T_F$) will provide sufficient accuracy. The output signal from multiplier circuit 80 ($KT_F$) is introduced along with instantaneous torque (T) from contact 76 of switch 72 into a comparator 82 in the form of a suitable subtraction circuit. When the two values are approximately equal, an output signal (U) is produced by comparator 82 and fed into solenoid valve 20 causing the valve to shut off the flow of fluid to tightening system 10.

Figure 5:
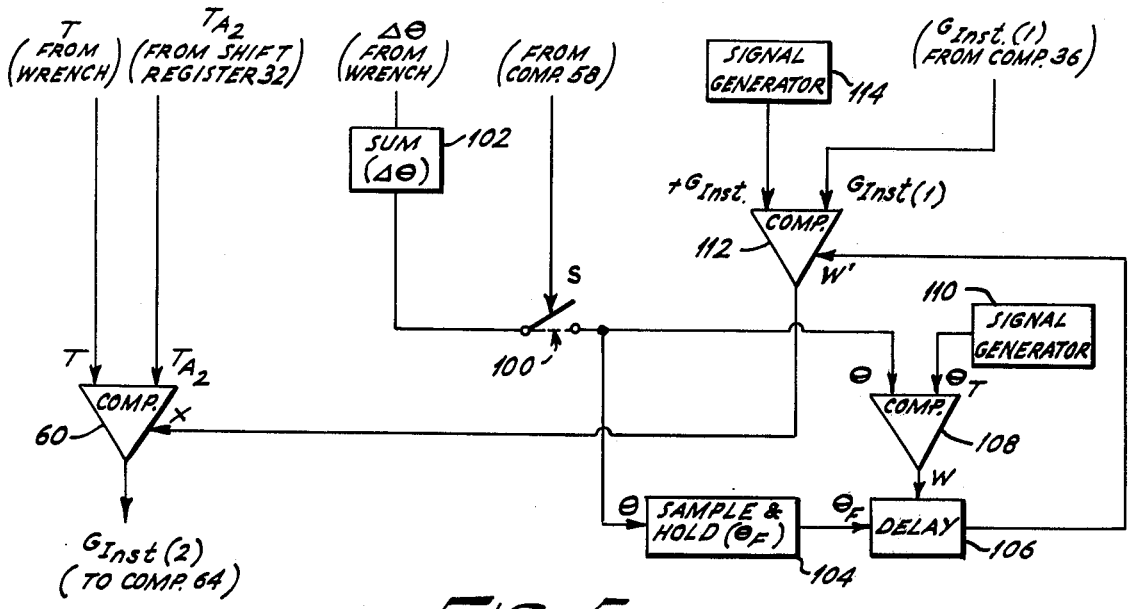
FIG. 5 is a schematic block diagram illustrating a third embodiment of the invention.
Figure 6:
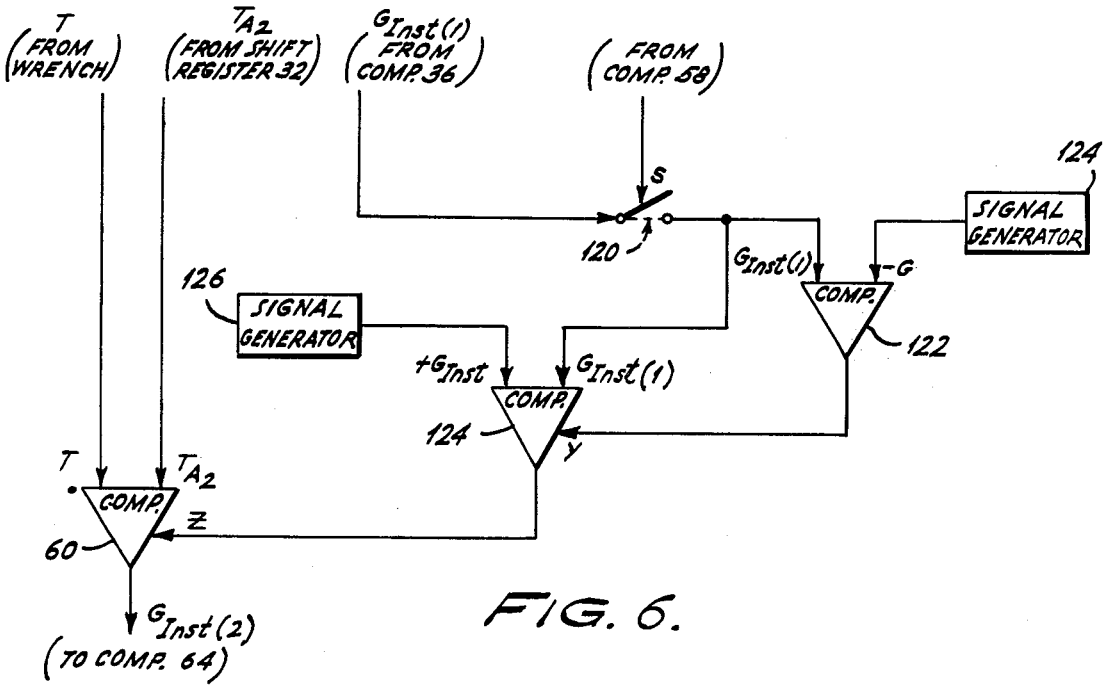
FIG. 6 is a partial schematic block diagram illustrating fourth and fifth embodiments of the invention.

In FIGS. 5 and 6, several more embodiments of the present invention are illustrated and will now be described. Each of the embodiments includes a tightening system 10 identical to the previously illustrated and described tightening system in FIG. 3. While each embodiment includes a control system similar to control system 31 in FIG. 3 which utilizes torque and rotation signals from the wrench, it should be understood that any of the control systems illustrated and described in previously mentioned U.S. Pat. Nos. 3,974,883 or 3,982,419, or U.S. Pat. applications Ser. No. 672,093, now U.S. Pat. No. 4,027,530, and Ser. No. 672,094, now U.S. Pat. No. 4,023,406, could be utilized instead. The disclosures of the noted patents and patent applications are incorporated herein by reference. It should further be understood that any control system for sensing a desired point on a curve of two variables of the type shown in FIG. 2 could be utilized as well. In the event that input tightening characteristics other than torque and rotation are utilized, then these parameters may be readily substituted, as described in the noted patents and patent application.

For example, in order to use the control parameters torque and time, as disclosed in U.S. Pat. No. 4,023,406 to Benz, encoder 26 with teeth 30 on its outer periphery and proximity detector 28 are eliminated from the control systems illustrated in FIGS. 3 and 4, and these elements are replaced by oscillator 34 illustrated in FIG. 2 of the Benz patent. Accordingly, in FIG. 5, the $\Delta\theta$ signals to summing circuit 102 would originate from oscillator 34 in the Benz patent instead of from the wrench (i.e. proximity detector 28) as labeled.

In order to utilize the control parameters motor speed and rotation, as disclosed in U.S. Pat. No. 4,027,530 to Tambini et al, the following direct substitutions would have to be made. In the first two embodiments, torque cell 24 and shift register 32 would be eliminated from FIGS. 3 and 4, and these elements would be replaced by oscillator 30, gate 32, D/A convertor 34, delay circuit 36, sample and hold circuit 38 and shift register 40 from FIG. 2 of the Tambini et al patent. As input "$\Theta_i$" from D/A convertor 34 of FIG. 2 of the Tambini et al patent would replace all inputs of instantaneous torque "T" from torque cell 24 to comparator 37 and switch 72 in FIG. 4. In a third embodiment, torque cell 24, shift register 32 and comparator 36 would be eliminated from FIG. 4 and be replaced by oscillator 60, gate 62, D/A convertor 64, delay circuit 66, sample and hold circuit 68 and differentiator 70 from FIG. 3 of the Tambini et al patent. In this embodiment, an input "$\Theta_i$" from D/A convertor 64 would replace all inputs of instantaneous torque "T" from torque cell 24 to comparator 37 and switch 72 in FIG. 4. The output from comparator 37 would then be fed to differentiator 70 instead of to the eliminated comparator 36. In the last embodiment, torque cell 24 and shift register 32 would be eliminated from FIG. 3 and be replaced by oscillator 60, gate 62, D/A convertor 64, delay circuit 66 and sample and hold circuit 68 from FIG. 3 of the Tambini et al patent. Also, comparators 36 and 60 would be eliminated from FIG. 3 and be replaced by a pair of differentiators 70 from FIG. 3 of the Tambini et al patent. Accordingly, an input "$\Theta_i$" from D/A convertor 64 would replace all inputs of instantaneous torque "T" from torque cell 24 to comparator 37 and switches 38 and 59 in FIG. 3. Comparator 37 would, in this embodiment, output a signal to one of the differentiators 70 in series with switch 38 and comparator 63 would similarly output a signal to the other one of differentiators 70. In FIGS. 5 and 6, the "T" signals to respective comparators 60 would be replaced by "$\Theta_i$" signals from D/A convertor 34 in FIG. 2 or by "$\Theta_i$" signals from convertor 64 in FIG. 3 of the Tambini et al patent, instead of from the wrench (torque cell 24) as labeled. Referring now to FIG. 5, an embodiment is shown in which the rotation ($\theta_F$) at thread forming torque ($T_F$) is determined, a fixed amount of rotation beyond ($\theta_F$) is allowed to pass, and thereafter a minimum positive gradient must be sensed before the control circuit is activated to determine the final tightened condition. It should be understood that the control circuit in the present embodiment is similar to that shown in FIG. 3, with the exception of the snug-sensing, turn-on circuitry. Output signal (S) from comparator 58, indicative of having reached point F in FIG. 2, closes a normally open, single-throw switch 100, allowing rotation signal ($\theta$) from a summing circuit 102 to pass to a sample and hold circuit 104. Incremental rotation pulses ($\Delta\theta$) from the wrench are summed in circuit 102 to provide rotation signal ($\theta$). The rotation signal ($\theta_F$) at thread forming point F is stored in circuit 104, and an output signal therefrom is introduced into a delay circuit 106 which also receives a signal (W) from a comparator 108. Comparator 108, in the form of a suitable subtraction circuit, receives rotation signal ($\theta$) from summing circuit 102 and a signal ($\theta_T$) representative of a fixed amount of rotation beyond ($\theta_F$) from a signal generator 110, and outputs signal (W) when the two input signals are approximately equal. Signal generator 110 is set to a fixed value which may be conveniently determined from tests made upon joints of the type being tightened. Upon receiving signal (W), delay circuit 106 passes a signal (W') to enable a comparator 112 in the form of a subtraction circuit, which also receives the instantaneous gradient signal [$G_{Inst\ (1)}$] from comparator 36 (FIG. 3) and a preset, positive gradient signal [$+G_{Inst}$] from a signal generator 114. The value from signal generator 114 is the minimum positive gradient which must be sensed before the control circuit is activated to determine the final tightened condition, such as point H in region III of FIG. 2. This minimum positive gradient value may also be determined from tests conducted on joints similar to the type being tightened. It should be pointed out that a suitable, conventional circuit would have to be used in the present embodiment in order to continue to receive signals [$G_{Inst\ (1)}$] from comparator 36 after signal (S) has been produced. Since this desired result is considered to be readily achieved by elementary circuit design, no further explanation will be included. When the two input signals to comparator 112 are approximately equal, an output signal (X) is produced to enable comparator 60 (FIG. 3), which receives instantaneous torque signals (T) from the wrench and signals ($T_{A2}$) from shift register 32. Signal (X) is then the signal which "turns on" the control system in tightening region III. The remainder of the control system functions in the same manner as described with respect to FIG. 3.

With reference to FIG. 6, an embodiment is illustrated in which a negative gradient is sought after reaching thread forming torque ($T_F$). Thereafter, the control circuit is activated upon sensing a minimum positive gradient. This embodiment is contemplated for use with joints exhibiting a torque rotation curve similar to curves 1 or 2 in FIG. 2. As in the previous embodiment of FIG. 5, it should be understood that the control circuit in the present embodiment is the same as that illustrated in FIG. 3 with the exception of the snug-sensing, turn-on circuitry. Output signal (S) from comparator 58 closes a normally open, single-throw switch 120, allowing instantaneous gradient signal [$G_{Inst\ (1)}$] from comparator 36 to pass to one input of a comparator 122 in the form of a subtraction circuit. The other input to comparator 122 is a negative signal (−G) from a signal generator 124, representative of a finite negative gradient signal. When the torque-rotation curve for the joint being tightened assumes a negative slope, and gradient signal [$G_{Inst\ (1)}$] generally equals the negative signal (−G) from signal generator 124, an output signal (Y) is developed. Signal (Y) is used to enable a comparator 124 which receives instantaneous gradient signal [$G_{Inst\ (1)}$] and a signal ($+G_{Inst}$) indicative of a minimun positive gradient from a signal generator 126. The value of such a minimum positive gradient may conveniently be determined from tests conducted on joints of the type being tightened. Upon reaching the minimum positive gradient, comparator 124 outputs a signal (Z) to enable comparator 60, which determines the gradient [$G_{Inst\ (2)}$] in tightening region III of FIG. 2, as previously described with respect to the control circuit in FIG. 3.

In the event that a torque-rotation curve similar to curves 3 or 4 in FIG. 2 is encountered, comparator 122 and signal generator 124 may be omitted from FIG. 6. In such a case, after thread forming torque ($T_F$) is reached and switch 120 is closed, a minimum positive gradient is sought by comparator 124 indicating that tightening region III has been reached.

Having thus described several embodiments of the present invention, it should be apparent that there have been disclosed several systems for tightening an assembly including a fastener exhibiting more than one installation region to an accurate predetermined tightened condition in any type of hole encountered. One such type of fastener is a thread forming fastener, and one example of such a predetermined tightened condition is the yield point of the joint. The systems described are reliable, accurate, relatively inexpensive to manufacture, and require only a minimum amount of prior knowledge about the particular joint being tightened. The present invention provides a long felt need in the field of automated tightening systems for the types of fasteners disclosed.

While in the foregoing there have been disclosed several embodiments of tightening and control systems in accordance with the present invention, various changes and modifications should be readily apparent to one skilled in the art and are within the intended scope of the invention as recited in the claims.

I claim:

1. Apparatus for tightening an assembly to a predetermined tightened condition, the assembly including a threaded fastener and workpiece combination wherein the fastener forms a mating thread in the workpiece material and wherein a curve of two input tightening characteristics which vary with respect to each other and which could be plotted for the assembly being tightened during a complete tightening cycle exhibits a thread forming region and a tightening region separated by a transition region, the apparatus comprising:

means for applying said input tightening characteristics to the fastener;

means for developing signals indicative of said input tightening characteristics;

first means responsive to said input tightening characteristic signals for developing a signal representative of the instantaneous gradient of said input tightening characteristics curve through which the assembly is being tightened;

second means responsive to said first means instantaneous gradient signal for determining a significant change in slope in the thread forming region on said curve and developing a signal indicating that a first condition has been reached;

third means responsive to said first condition signal for determining when the tightening region has been reached and developing a signal representative thereof;

fourth means enabled by said third means signal and responsive to said input tightening characteristic signals for developing a signal representative of the instantaneous gradient of said curve in the tightening region;

fifth means responsive to said fourth means instantaneous gradient signal for determining a significant change in slope in the tightening region and developing a control signal indicating that the predetermined tightened condition of the assembly has been reached; and means responsive to said control signal for discontinuing the application of input tightening characteristics to the fastener.

2. Apparatus in accordance with claim 1 wherein said third means includes means for determining the instantaneous value of one of said input tightening characteristics at said first condition, multiplying means for multiplying the value of said one of said input tightening characteristic signals at said first condition, and comparator means receiving the multiplied value of said one of said input tightening characteristic signals and the instantaneous value of said one of said input tightening characteristic signals for developing an output signal when said input signals thereto are approximately equal, said output signal being said third means signal.

3. Apparatus in accordance with claim 2 wherein said one of said input tightening characteristics is torque.

4. Apparatus in accordance with claim 1 wherein said third means includes determining means for determining the instantaneous value of one of said input tightening characteristics at said first condition and developing a signal representative thereof, delay means for delaying passage of said determining means signal for a fixed additional amount of said one of said input tightening characteristics, signal generating means for developing a signal representative of a fixed positive gradient and comparator means enabled by said delayed determining means signal and receiving said first means gradient signal and said fixed positive gradient signal for developing an output signal when said input gradient signals thereto are approximately equal, said output signal being said third means signal.

5. Apparatus in accordance with claim 4 wherein said one of said input tightening characteristics is rotation.

6. Apparatus in accordance with claim 5 wherein said delay means includes signal generating means for producing a signal indicative of a fixed amount of rotation, and comparator means receiving said signal generating means signal and a signal representative of the rotation of the fastener for developing an output signal when the input signals thereto are approximately equal, said delay means receiving said determining means signal and being clocked by said comparator means output signal in order to pass said determining means signal.

7. Apparatus in accordance with claim 1 wherein said third means includes first signal generating means for developing a signal representative of a finite negative gradient, first comparator means receiving said first means gradient signal and said finite negative signal for developing an output signal when said input gradient signals are essentially equal, second signal generating means for developing a signal representative of a fixed positive gradient, and second comparator means enabled by said first comparator means output signal and receiving said first means gradient signal and said fixed positive gradient signal for developing an output signal when said input gradient signals thereto are approximately equal, said output signal being said third means signal.

8. Apparatus in accordance with claim 1 wherein said third means includes signal generating means for developing a signal representative of a fixed positive gradient and comparator means receiving said first means gradient signal and said fixed positive gradient signal for developing an output signal when said input gradient signals thereto are approximately equal, said output signal being said third means signal.

9. Apparatus in accordance with claim 1 wherein said second means include means for storing said first means instantaneous gradient signal and for developing said first condition signal when said instantaneous gradient signal is a predetermined percentage of said stored signal.

10. Apparatus in accordance with claim 9 wherein said fifth means include means for storing said fourth means instantaneous gradient signal and for developing said control signal when said instantaneous gradient signal is a predetermined percentage of said stored signal.

11. Apparatus in accordance with claim 10 wherein said stored second means signal is representative of the maximum gradient in the thread forming region, and wherein said stored fifth means signal is representative of the maximum gradient in the tightening region.

12. Apparatus in accordance with claim 11 wherein said input tightening characteristics are torque and rotation.

13. Apparatus in accordance with claim 11 wherein said input tightening characteristics are torque and time.

14. Apparatus in accordance with claim 11 wherein said means for applying input tightening characteristics include motor-driven wrench means, and said input tightening characteristics are motor speed and rotation.

15. A system for installing a fastener which is capable of generating a mating internal thread in a workpiece hole to a final desired tightened condition comprising:

means for detecting a thread-forming characteristic of the fastener; and means responsive to said thread-forming characteristic and at least one known characteristic of the fastener for determining the final desired tightened condition.

16. A system in accordance with claim 15 wherein the final desired tightened condition is the yield point of the fastener and workpiece assembly.

17. A system in accordance with claim 15 wherein said thread-forming characteristic is the rotation required to form the thread.

18. A system in accordance with claim 15 wherein said at least one known characteristic of the thread-forming fastener is a predetermined amount of additional rotation after forming the thread to reach the final desired tightened condition.

19. A system in accordance with claim 15 wherein said thread-forming characteristic is the torque required to form the thread.

20. A system in accordance with claim 19 wherein said at least one known characteristic of the thread-forming fastener is a predetermined relationship between the torque at the final desired tightened condition and the thread-forming torque.

21. A system in accordance with claim 20 wherein said predetermined relationship is a ratio of the torque at the final desired tightened condition to the thread-forming torque.

22. Apparatus for installing a thread-forming fastener in a workpiece to a final tightened condition, said apparatus including:

first means for tightening the fastener and producing a signal indicative of a tightening characteristic;

second means for determining that an internal thread has been formed in the workpiece and for providing a signal indicative thereof; and third means responsive to the output signals of said first and second means for determining the final tightened condition and producing an output signal indicative thereof, said first means discontinuing tightening of the fastener in response to the output signal of said third means.

23. Apparatus in accordance with claim 22 wherein said third means includes means for determining the torque required to form the internal thread in the workpiece and means responsive to said determined torque and the instantaneous torque being applied to the fastener.

24. Apparatus in accordance with claim 23 wherein the final tightened condition is a torque value which bears a relationship to said thread-forming torque.

25. Apparatus in accordance with claim 23 wherein the final tightened condition is the yield point of the fastener and workpiece assembly.

26. Apparatus in accordance with claim 22 wherein the final tightened condition is the yield point of the fastener and workpiece assembly.

27. A method of installing a thread-forming fastener in a workpiece to a final tightened condition comprising the steps of:

tightening the fastener and producing a signal indicative of a tightening characteristic;

determining that an internal thread has been formed in the workpiece and providing a signal indicative thereof;

providing a signal indicative of a thread-forming characteristic of the fastener when the internal thread has been formed; and tightening the fastener to the final tightened condition in response to said tightening characteristic signal and said signal indicative of determining that the internal thread has been formed, said final tightened condition bearing a relationship to said thread-forming characteristic signal.

28. A method in accordance with claim 27 wherein said tightening characteristic signal is the instantaneous torque being applied to the fastener and said thread-forming characteristic signal is the torque required to form the internal thread in the workpiece, and wherein the fastener is tightened to the final tightened condition in response to said thread-forming torque and the instantaneous torque being applied to the fastener.

29. A method in accordance with claim 28 wherein the final tightened condition is an instantaneous torque value which bears a relationship to said thread-forming torque.

30. A method in accordance with claim 28 wherein the final tightened condition is the yield point of the fastener and workpiece assembly.

31. A method in accordance with claim 27 wherein the final tightened condition is the yield point of the fastener and workpiece assembly.

32. A method for determining a final desired tightened condition of a fastener during installation, wherein the fastener is capable of generating a mating internal thread in a workpiece hole comprising the steps of:

producing a signal indicative of an input tightening characteristic of the fastener being installed;

detecting a thread-forming characteristic of the fastener; and determining the final desired tightened condition in response to said thread-forming characteristic and a predetermined value of said input tightening characteristic signal of the fastener being installed.

33. A method in accordance with claim 32 wherein the final desired tightened condition is the yield point of the fastener and workpiece assembly.

34. A method in accordance with claim 32 wherein the thread-forming characteristic is the rotation required to form the thread.

35. A method in accordance with claim 32 wherein said predetermined value of said input tightening characteristic of the fastener being installed is a predetermined amount of additional rotation after forming the thread to reach the final desired tightened condition.

36. A method in accordance with claim 32 wherein said thread-forming characteristic is the torque required to form the thread.

37. A method in accordance with claim 36 wherein said predetermined value of said input tightening characteristic of the fastener being installed is a predetermined relationship between the torque at the final desired tightened condition and the thread-forming torque.

38. A method in accordance with claim 37 wherein said predetermined relationship is a ratio of the torque at the final desired tightened condition to the thread-forming torque.

* * * * *